United States Patent [19]

Doutney

[11] 4,412,733

[45] Nov. 1, 1983

[54] BELT DEVELOPING APPARATUS

[75] Inventor: George J. Doutney, Danbury, Conn.

[73] Assignee: Pitney Bowes Inc., Stamford, Conn.

[21] Appl. No.: 298,714

[22] Filed: Sep. 2, 1981

[51] Int. Cl.[3] ..... G03G 15/08; G03G 15/09

[52] U.S. Cl. ..... 355/3 DD; 118/657

[58] Field of Search ..... 355/3 R, 3 BE, 3 DD; 118/656, 657, 658

[56] References Cited

U.S. PATENT DOCUMENTS

| | | | |
|---|---|---|---|
| 3,257,223 | 6/1966 | King | 355/3 DD X |
| 3,437,074 | 4/1969 | Hagopian et al. | 355/3 DD X |
| 3,921,578 | 11/1975 | Genthe et al. | 355/3 DD X |
| 4,067,295 | 1/1978 | Parker et al. | 355/3 DD X |

*Primary Examiner*—Fred L. Braun

*Attorney, Agent, or Firm*—Michael J. DeSha; William D. Soltow, Jr.; Albert W. Scribner

[57] ABSTRACT

Within an electrophotographic copier having a moving photoconductor member, a dry magnetic developing apparatus has an endless web for the purpose of transporting dry magnetic developer material from the supply to the developing zone. The web is constructed from a material formed of an inner electrically insulative base and with a textured, electrically conductive outer surface capable of picking up a supply of developer material. The dry developer material is then caused to tumble upon the web and through the gap defining the developing zone, under the influence of fixed magnets located within the developing apparatus. The tumbling action greatly extends the opportunity to provide toner to the charged image along the arcuate path which includes the development zone between the carrier web and the photoconductor.

7 Claims, 5 Drawing Figures

Fig. 2.
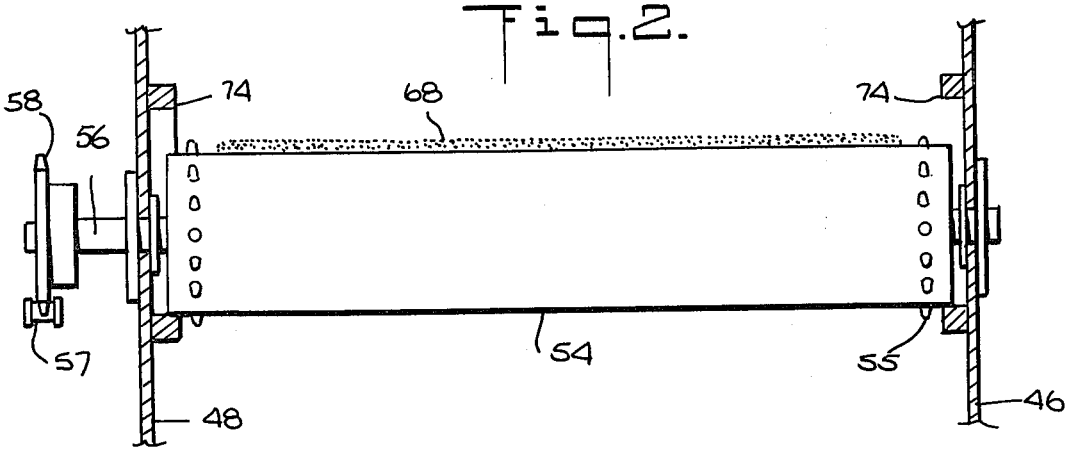
Fig. 3.
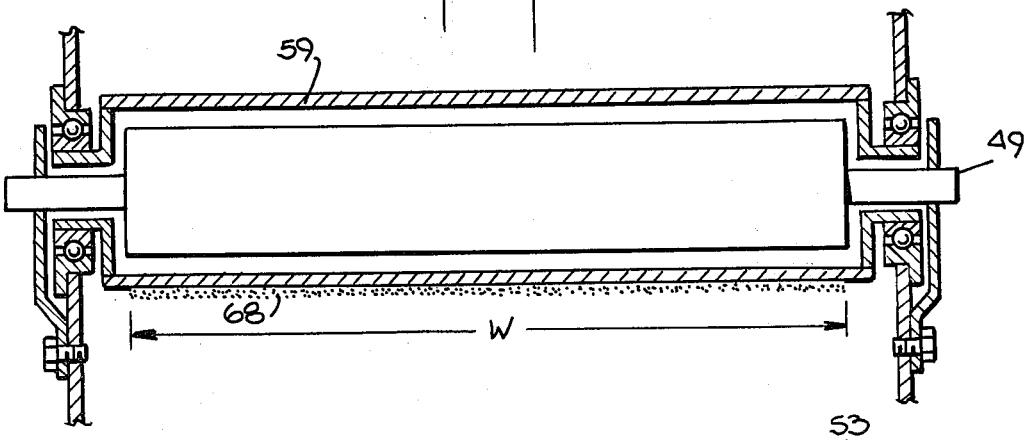
Fig. 4A.
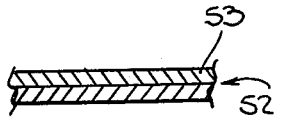
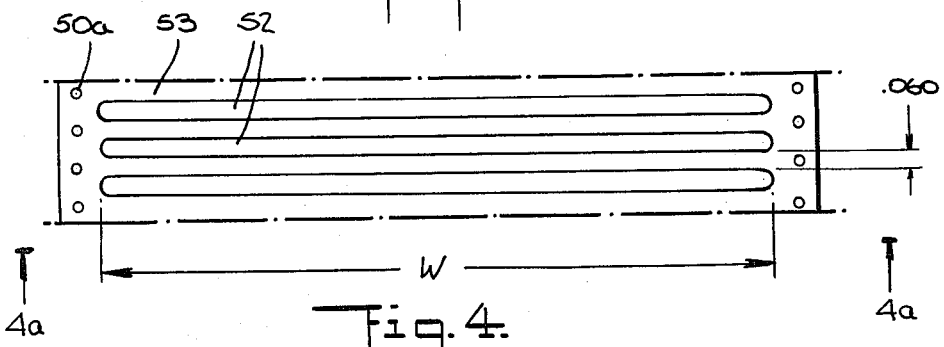
Fig. 4.

BELT DEVELOPING APPARATUS

BACKGROUND OF THE INVENTION

The present invention relates to photo reprographic copying machines and particularly to dry magnetic developing apparatus utilized therein.

In copiers utilizing dry magnetic developing apparatus, there has been a constant search for ways to achieve significant improvements in the copy output quality. Copy quality comes largely from the developing apparatus, and more particularly from the mechanisms involved which distribute and feed the developer material to the exposed photoconductor image carrier within the copiers process system.

The photoconductor is typically coated upon a holding member such as a drum, a flexible endless web, or an advancible film type carrier device with accommodating spools which are stored within a support cylinder. When the copier is activated by an operator, the photoconductor is electrically sensitized in advance of reception of an optically transmitted image of an illuminated object. The object is typically any original document which is placed face down upon a glass platen, the platen appropriately located on an upper working surface of the copier. The original is illuminated by stationary or reciprocating scanning apparatus located within the confines of the machine and positioned beneath the glass platen. During the illumination-scanning function, the image of the original is transmitted through the copiers optical system in a fashion not unlike the imaging system of a camera. During this process, the image is received on the photoconductor, and carried thereon to an area encompassing a portion of the photoconductor called the development zone, the latent exposed image is visibly developed by developer material which is electrostatically attracted to the previously exposed image.

The photoconductor continues on a predetermined path away from the development zone towards a transfer area. For every exposed image of an original document, a piece of copy paper is provided from a supply stack so that each sheet is transported, registered, and held against the moving photoconductor. While progressing through the transfer zone, an appropriately mounted corona, or transfer roller, applies an electrical charge through the copy sheet, thereby causing physical transfer of the developed image to the sheet.

Immediately after the leading edge of the copy sheet has received the leading end of the image, a detacking mechanism forces the leading end of the sheet away from the photoconductor. Then a separate transport system carries the copy sheet towards a fusing or fixing apparatus where radiant energy, heated hot roller pressure, or cold pressure of substantial magnitude is exerted upon the sheet as it passes through the apparatus. Immediately after fixing, the copy sheet is delivered in a sheet receiving tray to the machine operator.

The developing apparatus described in prior art typically has been provided with various instrumentalities designed to distribute, mix, circulate and apply developer material at the process development zone. In later prior art, an emphasis towards multiple developer applicator rolls has been demonstrated. The multiple applicator rollers are provided in various geometric variations and combinations that encompass the development zone. These rollers circulate the developer material through the developing apparatus and development zone in such a manner so that the developer is continuously passed along in a chain-like fashion brush form.

In addition, there are magnets mounted inside the rollers which may be either fixed or rotating. The magnets provide a substantial force in the form of magnetic flux which attracts the developer material unto the outer cylindrical surface of each applicator roller. The developer material is caused to stand up under influence of the magnetic flux so that it bristles radially outwards over a segment of the cylindrical roll surface, the bristle brush then engaging the photoconductor for the purpose of providing the toner constituent from the developer at the charged, exposed image.

When multiple applicator rollers are used in the developing apparatus, there is a better opportunity for development, since the multiple brushes present developer material to a given charged photoconductor image area over an extended time and distance. Ultimately, the net result in copy quality in terms of overall development is immediately seen when large solid areas representing the solid areas of an original are developed.

Similarly, there is also prior art which describes use of belt developer material applicator devices for conveying and applying the developer in a brush-like manner to the charged image on a photoconductor member. Such a system which utilizes belts is described henceforth in a brief abstract of an earlier issued patent.

PRIOR ART

In U.S. Pat. No. 2,832,311, issued to J. F. Byrne, a developing apparatus is disclosed which includes a particular combination of two endless, driven belts which are mutually mounted within a developing unit designed to handle dry magnetic developer material. Suspension for the belts is provided so that one belt is mounted inside the other, the outermost belt having direct contact with the developer material.

The outer belt is fabricated from a screen-like, nonmagnetic material, and the inner belt from a material capable of supporting separate attached magnet bars which are spaced apart and fastened to its entire circumferential inner surface. There are also separate tractor spaced apart nonmagnetic bars attached to the inner circumferential surface of the outer belt, the bars being longer than the lateral width of the belt. The overhanging outer belt bars engage rims provided on the ends of the photoconductor holding drum, for the purpose of maintaining a gap between the outer belt surface and the photoconductor.

During operation, the magnetic bars on the inner belt provide a series of moving bristle brushes formed of developer material, which engage the photoconductor held upon the drum over an extended area comprising the developing zone.

SUMMARY OF THE INVENTION

The present invention generally relates to the dry developing apparatus in a copier which utilizes dry magnetic toner. The apparatus includes means for holding a supply of dry magnetic developing material and an endless flexible web having a textured surface capable of carrying dry developer. The web is suspended upon guide means which support it while the developing material is presented to the moving photoconductor member. There are additionally magnetic means mounted in juxtaposition to the photoconductor and intermediate the guide means for the web so as to establish a gap between the magnetic means and the surface of the moving photoconductor in order to establish a developing zone in which the developing material carried upon the web is tumbled through the zone for the purpose of developing a charged image on the moving photoconductor.

OBJECTS OF THE INVENTION

It is a primary object of the present invention to provide a dry magnetic toner developing apparatus which greatly extends the development zone where toner is applied to a charge image.

It is another object of the invention to provide a dry developing apparatus which presents a means of causing repeated tumbling of the dry magnetic developing material in a gap between the developer conveyor and the moving photoconductive surface carrying charged images.

DESCRIPTION OF THE DRAWINGS

FIG. 2 is a partial sectional view taken generally from FIG. 1, along lines 2—2, to illustrate the suspension of the guide means provided for the web device utilized in the invention.

FIG. 3 is a partial sectional view taken generally from FIG. 1, along lines 3—3, to show the suspension of a typical fixed magnet provided within a web guide cylinder.

FIG. 4 is a partial view taken generally from FIG. 1, to show a portion of the web member with its outside surface pattern.

FIG. 4*a* is a partial sectional view taken generally from FIG. 4, to show the two layered construction of the developer carrier web.

DETAILED DESCRIPTION OF THE INVENTION

Figure 1:
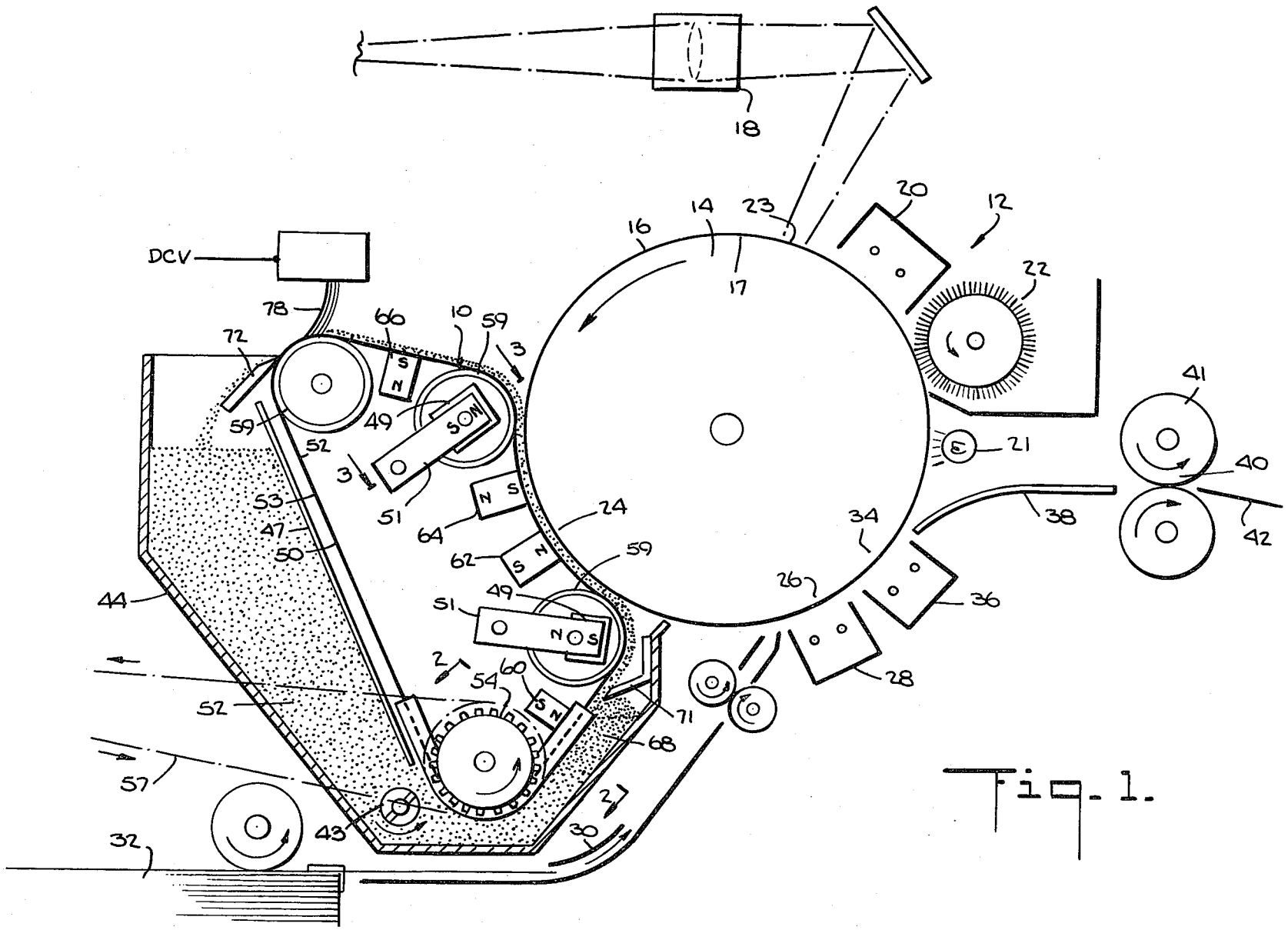
FIG. 1—Generally represents a sectional side view of a developing apparatus which is mounted adjacent to a photoconductive drum having reprographic instrumentalities.

Referring to FIG. 1, there is illustrated a sectional side view of a dry magnetic developing apparatus generally depicted as 10. The developing apparatus 10 is arranged to operate in conjunction with a photoreprographic process system of a copier, which is generally depicted 12. The copier process includes various instrumentalities such as a photoconductor support drum 14, having a photoconductor member 16 coated on the outermost surface 17 of the drum 14.

The reprographic process includes means to transpose the image of an illuminated original document through a partially shown optical system 18. The image of the original document is presented from the illumination platen (not shown), which supports the document during the scanning portion of the reprographic process.

In addition, there is provided a photoconductor 16 sensitizing device 20 which electrically charges the photoconductor 16 to a desired, predetermined polarity and voltage level prior to image reception through an optical system 18, which is partially shown within FIG. 1. And, located prior to the sensitizing function, there is provided a photoconductor 16 cleaning apparatus 22 which functions after being discharged by a suitable discharge lamp 21 in order to remove excess developer material remaining from previous use of the copier system.

At the general area designated 23, the image is exposed upon the sensitized photoconductor 16 which is rotatably driven with constant speed towards the developing zone 24. Toner, from the developer material 68, is electrically attracted to the exposed, charged image as the photoconductor 16 continues in its arcuate path *through the developing zone* 24.

From the developing zone 24, the photoconductor carries the developed image forward to the image transfer zone 26, where a transfer corona 28 causes the developed image to migrate to a piece of copy paper 30, which is fed from a supply stack 32 at a predetermined time designed to register and meet the leading end of the developed image.

At such time that the leading end of the copy sheet 30 passes through the transfer zone 26, it immediately enters a detack area where a detack corona device 36 causes the sheet 30 to become electrostatically removed from the photoconductor 16 surface.

Immediately upon having been electrostatically removed from the photoconductor 16, the sheet 30 is then guided across a fixed structural member 38, which leads to the nip 40 of a fusing apparatus 41.

The unfused image carried upon sheet 30 becomes permanent when the sheet 30 passes through the fusing apparatus 41, from which each copy sheet 30 is then ejected into a suitable receiving tray 42.

In reference to the developing apparatus 10 illustrated in FIG. 1, it is pointed out that the apparatus is generally shown with one supporting side frame (48) removed, for the purpose of clarity. There are a number of different structural members which comprise the framework and general construction of a developing unit 10, such as the developer holding sump pan 44 which is rigidly secured to the front and rear developing unit side frames 46 and 48 respectively (FIGS. 2 and 3). There is also a shield 47 secured between the frames 46 and 48, in addition to the fixed magnet members 49 which are also secured to the frames 46 and 48 through the arm members 51. The open boxlike structure of the developing apparatus 10 is tightly sealed and mechanically fastened by means not shown at all joints where the structural members 44, 47, and bearings for all guide members are either fixed or supported by frames 46 and 48.

Suitably confined, guided and supported within the developing unit structure 10, there is provided a flexible, endless web 50, which is comprised of several layers to be described in detail later in the present specification.

The supportive guide means for web 50 consists of an arrangement of rotable cylinders and rollers, all of which are suitably journaled in bearings appropriately mounted in the side frames 46 and 48 (FIGS. 2 and 3).

In addition to the web 50 guide support members, a rotatable mixing auger 43 is provided in the sump pan 44 for the purpose of continuously mixing the developer material 68, and pushing the developer 68 towards web 50.

As illustrated in FIG. 4*a*, the web 50 is composed of several layers, the innermost layer 52 being a thin plastic film such as that sold under the trademark MYLAR a trade name for flexble plastic, in this case 0.004" thick. The outermost layer 53 of web 50 is aluminum, which is clad to the MYLAR layer 52, and is further texturized into a pattern suitable and capable of picking up and carrying dry magnetic developer material. The texturized pattern comprising the majority of the outer surface 53 of web 50 is provided from a secondary process such as, for example, an etching process. The web 50 is coated on the aluminized surface with a suitable material which receives an illuminated image of a pattern exposed from a black and white master. The web with the resulting imaged pattern is then immersed into an etching bath which eats away the aluminum in those shadowed image areas constituting the original desired pattern on the master.

For the purpose of further explanation refer to FIGS. 4 and 4*a* where a pattern comprised of depressed bars and spaces is considered to be satisfactory for the present invention. The bar pattern is best adapted to the present invention by aligning the pattern to run parallel with the web support and guide charge into surface 53, the bar pattern does not run off the lateral ends of the web and a suitable electrical charge applying device, to be described later, runs on one edge of the end of the pattern. A pitch of approximately 0.060" between depressed bars, and an overall width "W" which substantially covers the length of the fixed magnet members 60, 62, 64 and 66 underlying web 50, to ensure adequate coverage of the lateral width of an image to be developed.

The web 50 is rotatably driven by a cylinder 54, (FIG. 2), which has suitable engaging plastic sprocket teeth 55 at both ends, which engage sprocket holes 50*a* in the web 50. The cylinder 54 is supported by suitable end caps, (not shown), and further connectively engaged to a support shaft 56 which in turn is appropriately supported in the side frames 46 and 48 by suitable bearings.

Input power to drive the cylinder 54 is provided from a main motor serving as a power source (not shown), which is connectively engaged through a chain member 57. Also not shown is a connection for driving the mixing member 43, from the chain member 57.

It is important to recognize that cylinder 54 was selected to be the drive capstan for driving the web 50 because of the relative distance of the cylinder 54 from the development zone 24, with respect to the overall length of the web 50 there between. To enable assembly of the web 50 over all the guide and support cylinders 54 and 59, there is provided a modest amount of slack in the web 50, which also easily allows the web to be installed over the sprocket teeth 55. Upon energization of the copier, this web slack is immedately used to advantage since the developer material 68 is attracted to all fixed magnets 60, 62, 64 and 66 through the web 50. It will be recognized that a substantially uniform gap is therefore maintained along the development zone 24 between the web 50 and the photoconductor surface 16.

The web 50 moves along its predetermined path as defined, and secures the appropriate amount of the developer material 68 from the sump pan 44 during its motion. Accordingly, the textured surface 53 previously described on the web 50 provides the developer material to a stripper-doctor blade member 71, which restricts to a desired amount the developer 68 as it is carried towards the developing zone 24.

The fixed magnet 60, and the fixed magnet 49 serve to ensure that the magnetic developer material is carried forward around the first guide cylinder 59, towards the developing zone 24. Referring to FIG. 3, developer material 68 is depicted as it lies upon the web 50, and a corresponding guide support cylinder 59. It is important that the brush length formed by the developer 68 will only be as long as the fixed magnet member 49, which also corresponds to the length "w" of pattern 53 formed on the web 50 (FIG. 4). To further ensure that the developer 68 does not get under the web 50 where it may become trapped, and cause damage to the plastic film surface 52, there are provided separate end web seals 74 and 76 (FIG. 2). The seals 74 and 76 are made of any suitable material such as closed cell foam of a material suitable to provide contamination protection from the developer 68.

However since the developer 68 is substantially carried and tumbled along the textured surface 53 in the center of the web 50, in the space designated "w", the developer 68 does not reach the ends of the web 50. The seals 74 and 76 therefore are provided as a second defense against potential problems caused by wandering developer material that would otherwise damage the web 50. During the conveyance of the developer 68 to the development zone 24, the fixed magnets 60, 49, 62 and 64 cause a jumping action upon the developer material 68. While the web 50 pulls and pushes the developer 68, the magnets continuously attract the developer 68 so that the developer 68 tumbles along in the same direction as the driven web 50. This tumbling action has been found to promote application of a greater amount of developer material 68 to the charged image on the photoconductor 16.

Once the toner constituent has been attracted to the charged image, the remaining magnetic carrier constituent of the developer 68, is caused to continue in a path back to the holding sump 44. There is a stripper blade 72 provided at the top of the developing unit 10, which is placed in close proximity to the outer web surface 53 to cause remaining material to be stripped away.

To provide the required electrical bias potential to the developing material 68 on the web 50, a suitable contact brush 78 is appropriately connected to a DC voltage supply source, and mounted to ride on one lateral end of the web 50.

While one embodiment of the invention at hand has been illustrated and described within the foregoing specification, it will be obvious to those skilled in the art that many changes may be made in the size, shape, detail and general arrangement. Therefore, the following claims are intended to capture the spirit and scope of the present invention.

What is claimed is:

1. A dry magnetic developing apparatus for use in an electrophotographic copier having a moving photoconductor on which an image is developed, said apparatus comprising:

a. means for holding a supply of dry magnetic developing material;

b. an endless web formed of flexible material and having a textured surface which is capable of carrying said developing material therewith;

c. guide means for guiding said web through said supply of developing material and to and from the moving photoconductor; and d. magnetic means fixedly mounted in juxtaposition to a surface of the photoconductor and intermediate said guide means and defining a gap between said magnetic means and said surface of the photoconductor through which said web passes, said gap defining an extended developing zone in which said magnetic means causes the developing material carried by said web to be tumbled thereon as said web passes through said extended developing zone for the purpose of developing a charged image on said surface of the photoconductor.

2. Apparatus according to claim 1 where said endless web is formed of two layers of material, an inner layer formed of an electrically insulating material and an outer layer formed of an electrically conductive material on which said textured surface is formed.

3. Apparatus according to claim 2 wherein said textured surface comprises a series of elongate depressions extending laterally over a majority of the width of said endless web.

4. Apparatus according to claim 1 wherein said gap is defined by an arcuate portion of said surface of the photoconductor and said juxtaposed magnetic means whereby said extended developing zone is arcuate.

5. Apparatus according to claim 4 wherein said guide means comprises a pair of rollers spaced apart along said arcuate portion of said photoconductor surface for supporting said web at opposite ends of said developing zone with sufficient slack so that said web is maintained in spaced relationship with said photoconductor surface throughout said developing zone by magnetic attraction of said developing material on said web to said magnetic means, and a driven cylinder located at a substantial distance from said developing zone for moving said web while maintaining said spaced relationship between said photoconductor surface and said web throughout said developing zone.

6. Apparatus according to claim 5 wherein said magnetic means comprises a plurality of magnets each having a surface juxtaposed said photoconductor surface, the ploarity of the magnets alternating along said developing zone, said magnet surfaces supporting said web in said spaced relationship with said photoconductor surface and causing tumbling of said dry magnetic developing material throughout said extended developing zone.

7. Apparatus according to claim 5 wherein said driven cylinder is located within said means for holding said supply of said developing material so as to guide said web through said developing material.

* * * * *